US006343480B1

(12) United States Patent
Correa et al.

(10) Patent No.: US 6,343,480 B1
(45) Date of Patent: Feb. 5, 2002

(54) CONDENSATE DRAIN ARRANGEMENT FOR AN AIR CONDITIONER

(75) Inventors: Juan C. C. Correa, Porto Alegre (BR); Nestor Hernandez, Nuevo Leon (MX); Peter R. Bushnell, Cazenovia, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,010

(22) Filed: Aug. 17, 2000

(51) Int. Cl.[7] ..... F25D 21/14
(52) U.S. Cl. ..... 62/288; 62/285; 62/291
(58) Field of Search ..... 62/285, 286, 288, 62/289, 291, 304, 85, 150, 272, 262

(56) References Cited

U.S. PATENT DOCUMENTS 3,724,233 A * 4/1973 Pugh et al. ..... 62/285
4,748,828 A * 6/1988 Chang ..... 62/272 X
5,697,227 A * 12/1997 Bruce et al. ..... 62/285
6,151,906 A * 11/2000 da Silva ..... 62/285 X

* cited by examiner

*Primary Examiner*—Henry Bennett
*Assistant Examiner*—Chen-Wen Jiang

(57) ABSTRACT

A condensate drain arrangement for an air conditioner, which includes a molded plastic basepan having a substantially horizontally extending bottom wall. The bottom wall has an outdoor section which includes a region for collecting condensate therein. A first condensate drain is formed in the basepan in fluid communication with the condensate collecting region. The first condensate drain is configured to conduct substantially all of the condensate collected within the region for collecting from the basepan. The first condensate drain is optionally enabled by the user of the air conditioner. A second condensate drain is also formed in the basepan in fluid communication with the region for collecting condensate. The second condensate drain is configured to allow collection of condensate in the collection region to a predetermined depth and to conduct condensate which would exceed said predetermined depth from the basepan. The second condensate drain is also optionally enabled by the user of the air conditioner. In a preferred embodiment, a condensate collector is configured to be mounted in the air conditioner housing to collect condensate from whichever of the condensate drains has been enabled. The condensate collector has a single outlet therefrom for conducting condensate to a desired disposal location.

5 Claims, 6 Drawing Sheets

CONDENSATE DRAIN ARRANGEMENT FOR AN AIR CONDITIONER

BACKGROUND OF THE INVENTION

The present invention relates to a room air conditioner and is more specifically directed to a two level condensate drain arrangement for the basepan of such an air conditioner.

Warm air is frequently humid, i.e. it contains entrained water vapor. During operation of an air conditioning system in a cooling mode, the evaporator reduces the temperature of the air passing through it to a temperature below the dew point. In that condition, water vapor condenses on the evaporator. Means are provided to collect the condensed water and to direct it to the outdoor section of the air conditioner where at least a portion thereof is quite often directed upon the system's condenser heat exchanger to improve the operating efficiency of the system. Excess condensate, and rain water that may pass into the outdoor unit through openings in the housing of the air conditioning unit, collect in the basepan and it is common practice to provide a drain outlet for conducting such excess condensate to an appropriate disposal location.

In systems that employ a system for directing condensate upon the system's condenser heat exchanger to improve efficiency, a condensate fan slinger arrangement is usually used. Such arrangement results in a certain level of noise as the slinger passes through collected condensate and directs the condensate into the flow of air passing to the condenser coil. It is accordingly sometimes deemed desirable not to have such a feature and to simply dispose of all collected condensate.

Accordingly, it is deemed desirable to have a window room air conditioner that has a simple optional capability of allowing condensate to collect to a level which is sufficient to supply a condensate slinger for efficiency purposes and also have the option to fully drain all collected condensate from the basepan of the air conditioning unit.

SUMMARY OF THE INVENTION

A condensate drain arrangement for an air conditioner, which includes a molded plastic basepan having a substantially horizontally extending bottom wall. The bottom wall has an outdoor section which includes a region for collecting condensate therein. A first condensate drain is formed in the basepan in fluid communication with the condensate collecting region. The first condensate drain is configured to conduct substantially all of the condensate collected within the region for collecting from the basepan. The first condensate drain is optionally enabled by the user of the air conditioner. A second condensate drain is also formed in the basepan in fluid communication with the region for collecting condensate. The second condensate drain is configured to allow collection of condensate in the collection region to a predetermined depth and to conduct condensate which would exceed said predetermined depth from the basepan. The second condensate drain is also optionally enabled by the user of the air conditioner. In a preferred embodiment, a condensate collector is configured to be mounted in the air conditioner housing to collect condensate from whichever of the condensate drains has been enabled. The condensate collector has a single outlet therefrom for conducting condensate to a desired disposal location.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
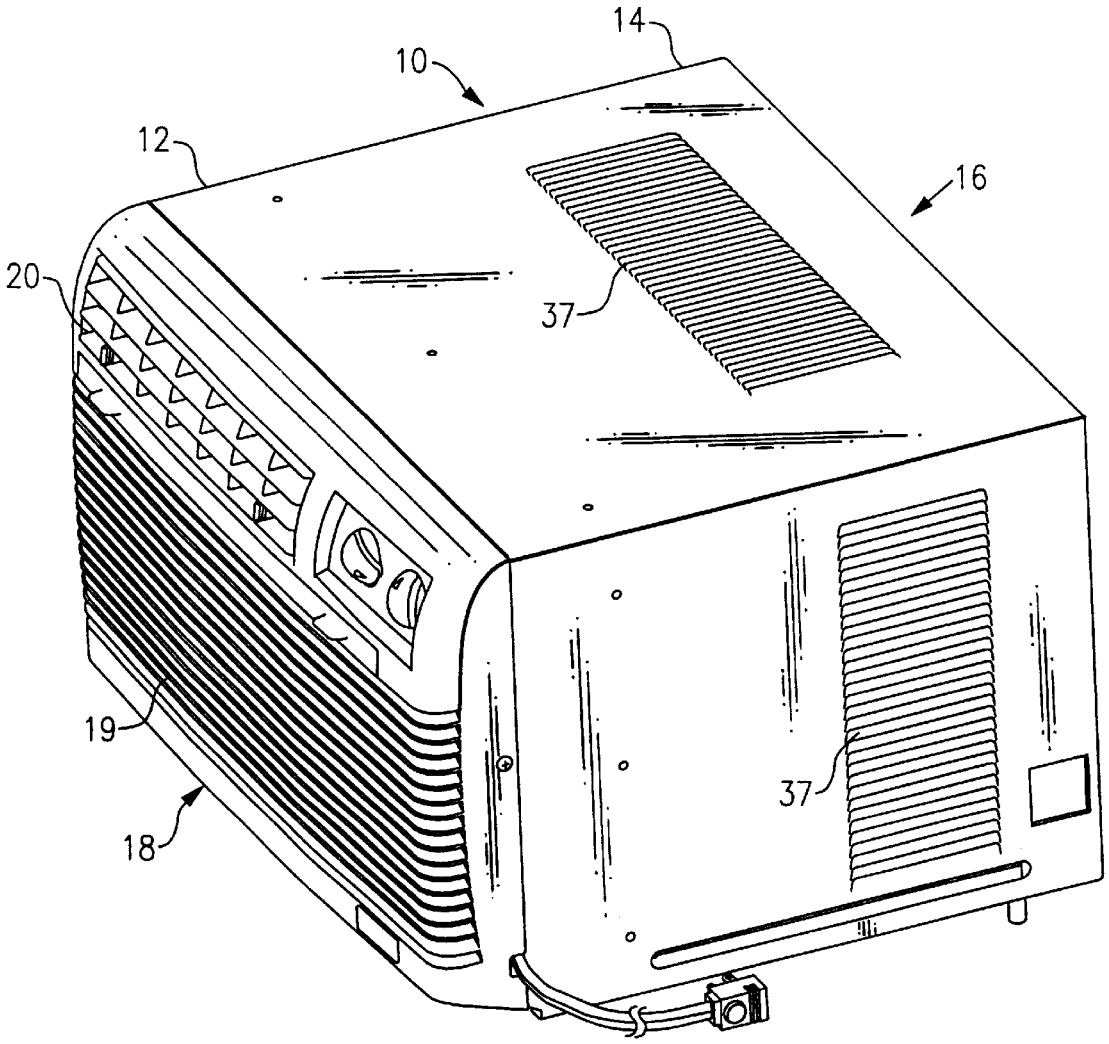
FIG. 1 is a perspective view of a window room air conditioner which embodies the features of this invention.

FIGS. 1–3 and 8 illustrate an air conditioner unit 10, which includes, generally, an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille 18, which includes inlet louvers 19 and an air discharge assembly 20.

Figure 2:
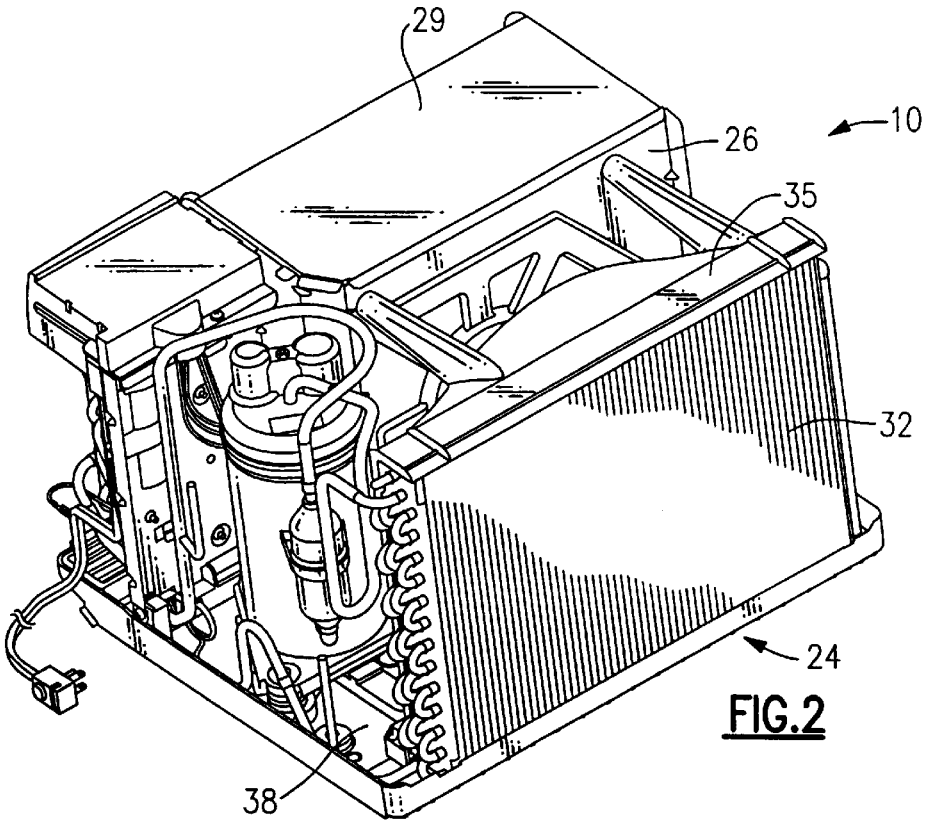
FIG. 2 is a rear perspective view of the air conditioner of FIG. 1 with the housing and front grille removed therefrom.
Figure 3:
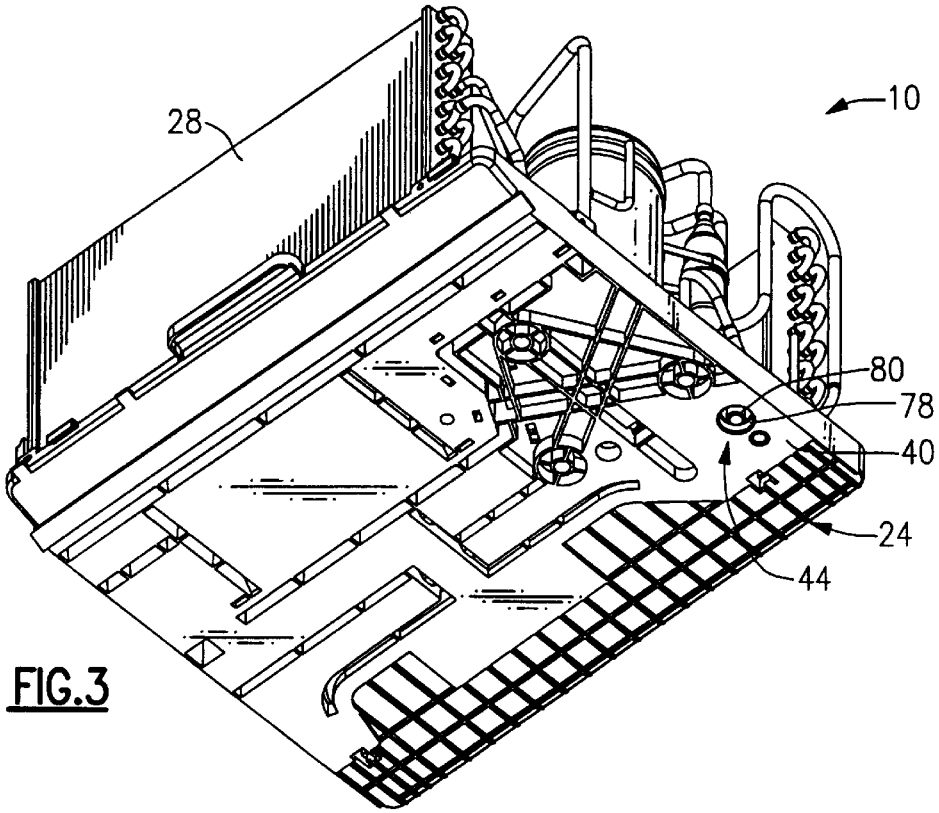
FIG. 3 is a bottom front perspective view of the air conditioning unit of FIG. 2.
Figure 8:
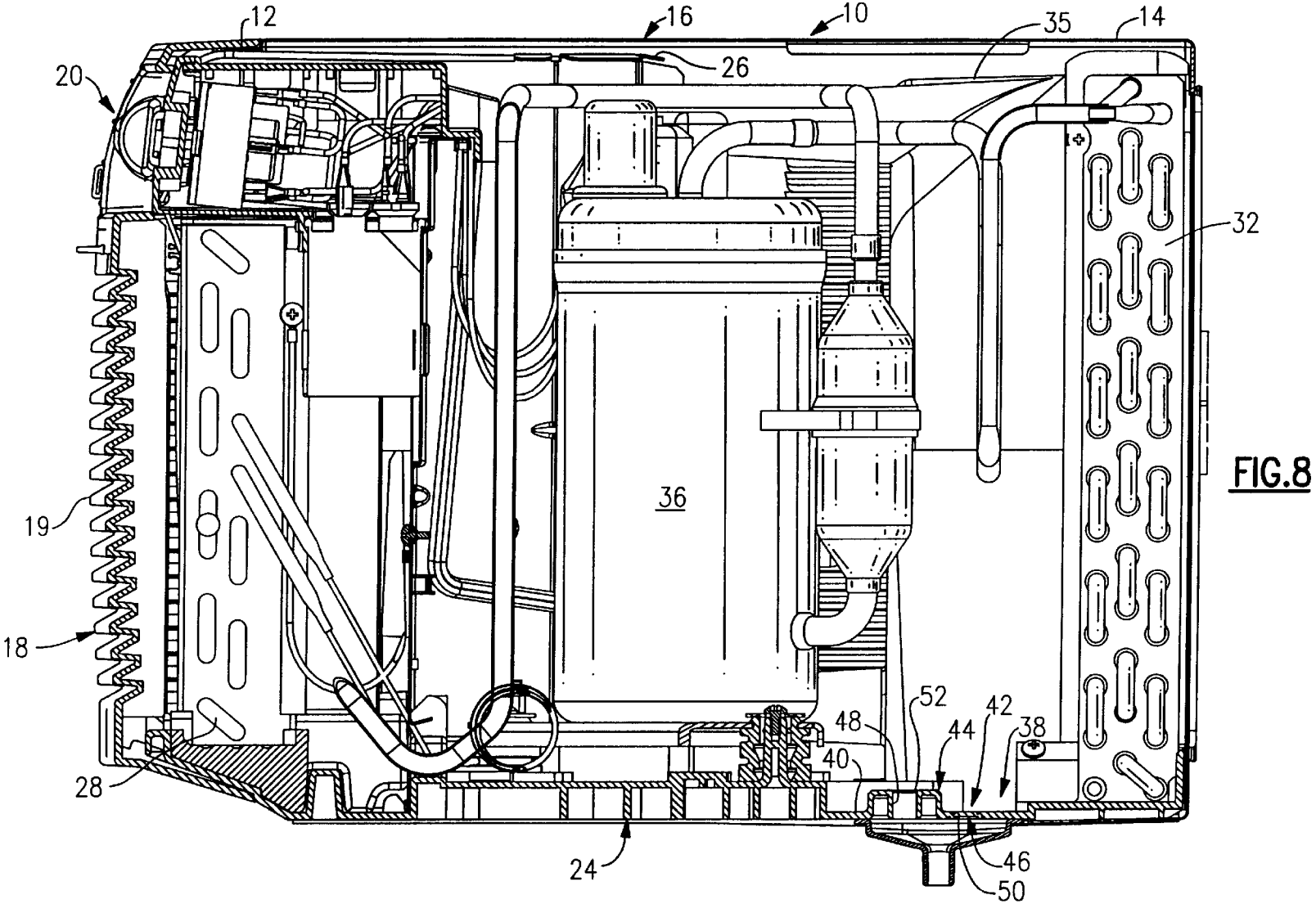
FIG. 8 is a side sectional view of the air conditioner of FIG. 1 taken through the condensate drains and condensate collector of the present invention.

Looking now at FIGS. 2, 3 and 8, the components of both the indoor section 12 and outdoor section 14 are supported in a rectangular basepan 24. The indoor and outdoor sections are separated by a vertically extending metal partition 26. The indoor section includes, basically, an evaporator coil 28 vertically disposed at the front end thereof, an evaporator or indoor fan (not shown) located behind the evaporator coil 28 and an air directing scroll 29.

The outdoor section 14 includes a condenser coil 32 vertically disposed adjacent the back end thereof, a condenser fan (not shown), located adjacent the condenser coil, and a fan shroud 35. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan through the inlet louvers 19 and is directed through the evaporator coil 28 where the air is cooled. The cooled air is then directed by the scroll 29 back into the room to be cooled through the air discharge assembly 20. At the same time, ambient air is drawn through inlets 37 in the outside section of the housing 16 and through the shroud 35, by operation of the condenser fan, and is directed through the condenser coil 32 before exiting from the backside of the condenser coil.

Figure 9:
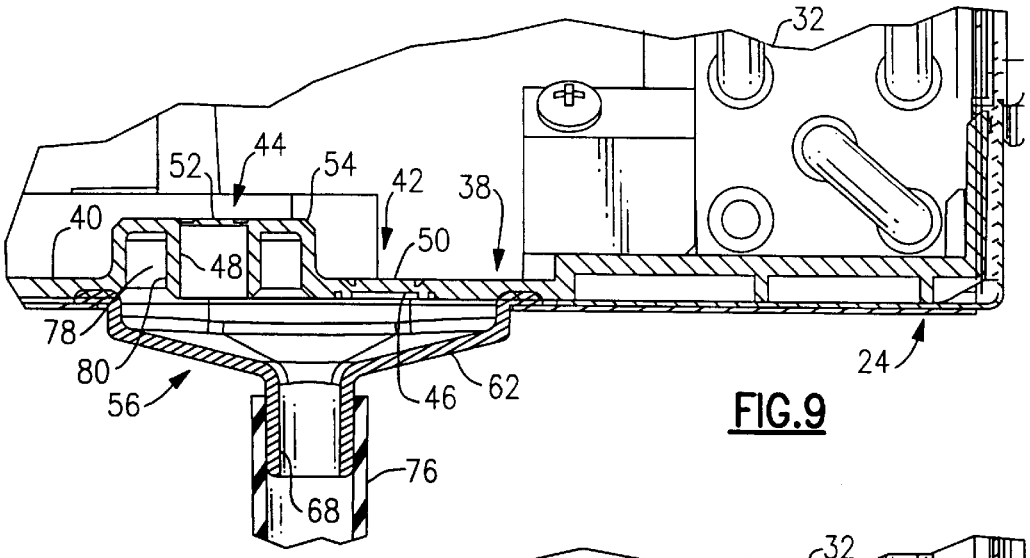
FIG. 9 is an enlarged view of the lower right-hand comer of FIG. 8 showing the invention with neither of the condensate drains enabled.

In cooling the air during its passage through the evaporator 28, condensate commonly forms and falls to the bottom of the coil where it is collected by an appropriate collection system and is directed through the partition 26 to the outdoor section of the basepan 24 where condensate is collected. This region is identified in FIGS. 2 and 8–11, generally by reference numeral 38. As best seen in FIG. 9, molded into the bottom wall 40 of the basepan 24 is a first condensate drain 42 and a second condensate drain 44, both of which are shown as originally formed in the basepan with their drain openings 46 and 48, respectively, sealed off by a removable web of plastic 50 and 52, respectively.

Figure 11:
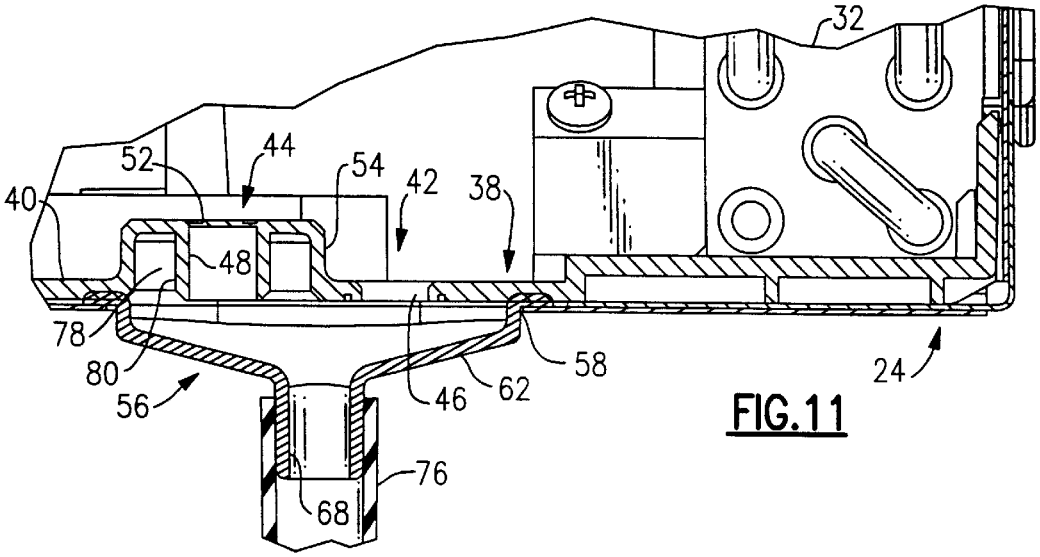
FIG. 11 is a view similar to FIG. 9 with the first condensate drain enabled.

The first drain 42 is at the same level as the bottom wall 40 of the basepan and it is illustrated in FIG. 11 with the removable web 50 removed therefrom to accordingly allow flow of condensate collected in the region 38 through the opening 46 from the basepan. The molding of the removable webs 50 and 52 are such that they may be readily removed by a mechanical tool such as a drill or a punch or the like.

Figure 10:
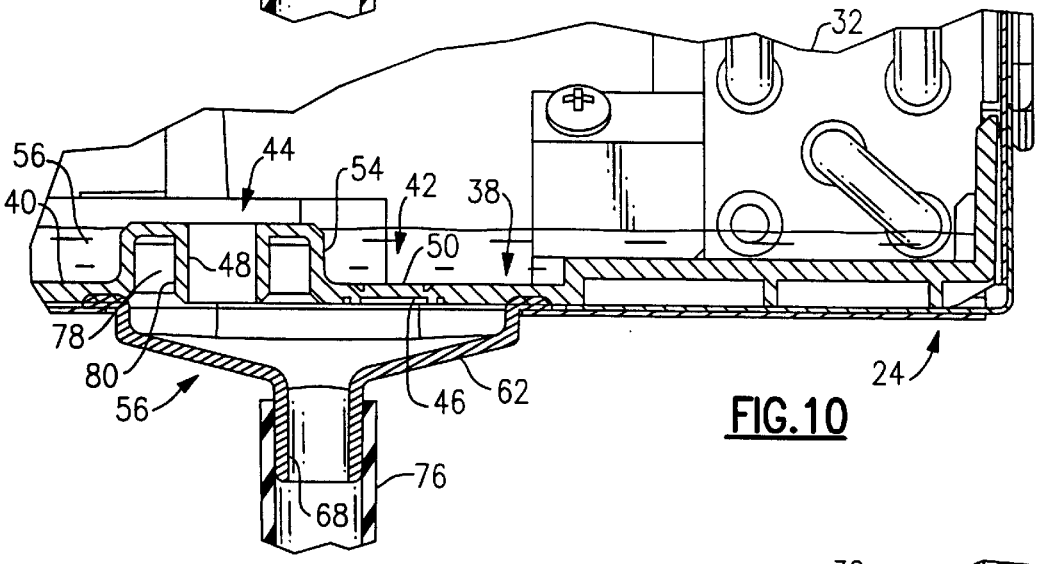
FIG. 10 is a view similar to FIG. 9 with the second condensate drain enabled.

The second condensate drain 44 is formed in a vertically extending boss 54 adjacent to the first drain 42. FIG. 10 illustrates the second drain enabled by removable of the web 52 which is located near the top of the boss 54. With the second drain enabled the condensate 55 is allowed to rise to the level of the boss before passage of excess condensate through the opening 48 for appropriate disposal.

It should be appreciated that the drains 42 and 44 are formed within the confines of the basepan and do not extend downwardly therefrom. This feature is particularly beneficial in that the chassis of the air conditioning unit comprising the basepan and all the internal components is of the type adapted to be removably slid into place within the outer housing 16. A structure extending beyond the bottom of the basepan accordingly would be subject to damage during the installation or removal of the chassis within the housing.

In order to collect the condensate which passes from either the first or second condensate drain, a condensate collector 56 is mounted in an opening 58 provided in a horizontally extending structural wall 60 of the housing and which underlies and is coextensive with the outlet of both the drain openings 46 and 48. The condensate collector 56 includes an elongated bowl-shaped main body 62 having an open top 64 with an outwardly extending annular flange 66 formed at the upper edge thereof. Extending downwardly from the lower end of the bowl-shaped main body 62 is a tubular outlet 68 having a through opening 70, which provides a flow path for condensate collected within the body.

Figure 4:
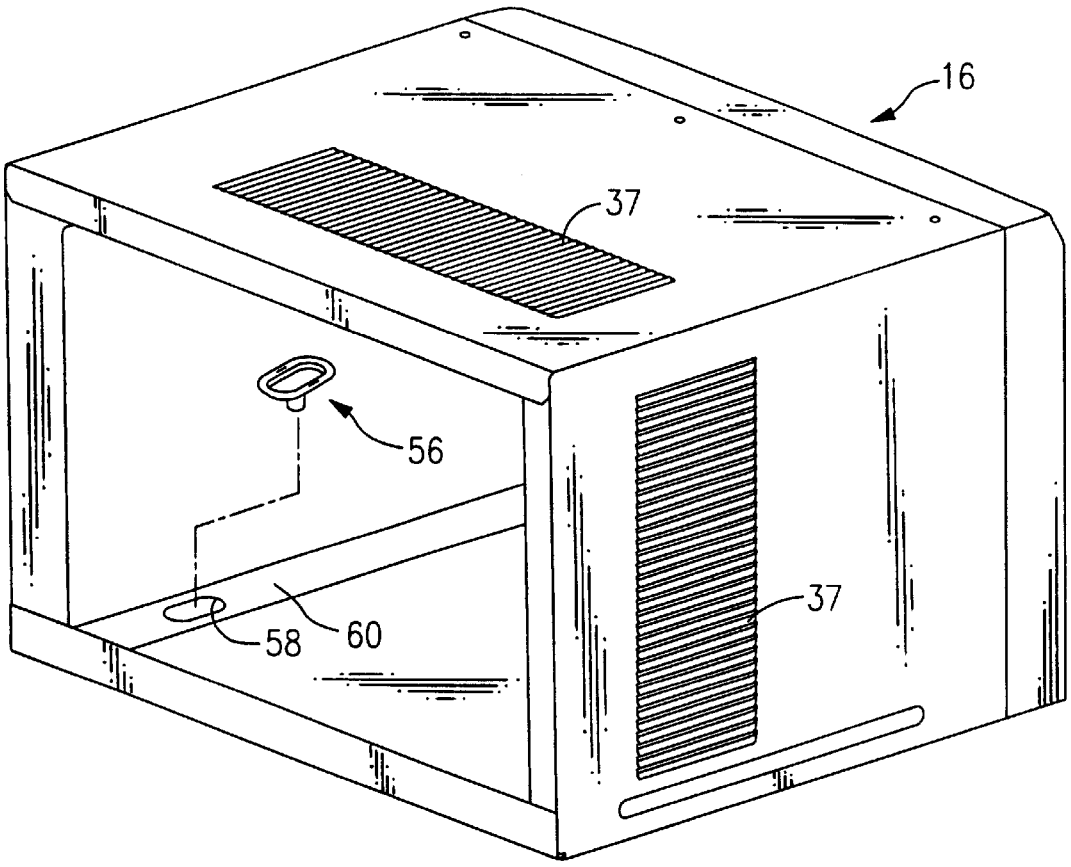
FIG. 4 is a rear perspective view of the housing of the air conditioner of FIG. 1 showing the condensate collector removed therefrom.
Figure 5:
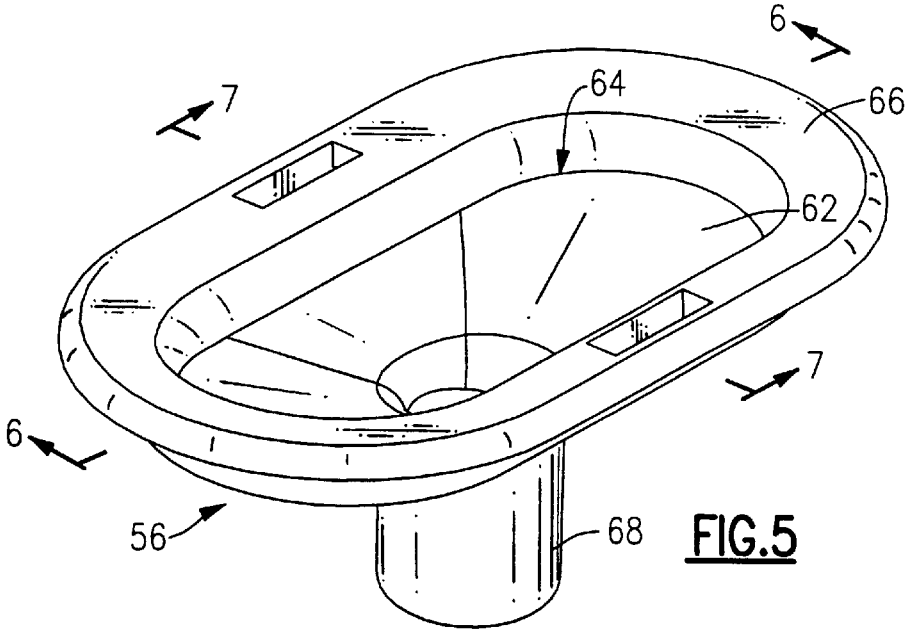
FIG. 5 is a perspective view of the condensate collector of the present invention.
Figure 6:
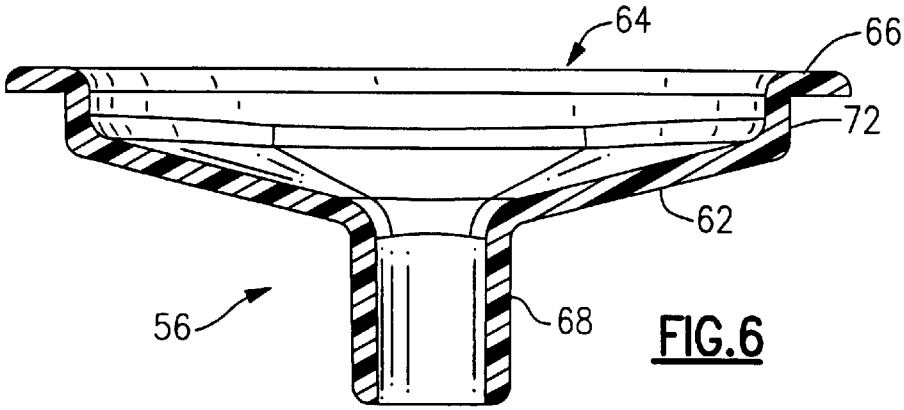
FIG. 6 is a section taken along the line 6—6 of FIG. 5.
Figure 7:
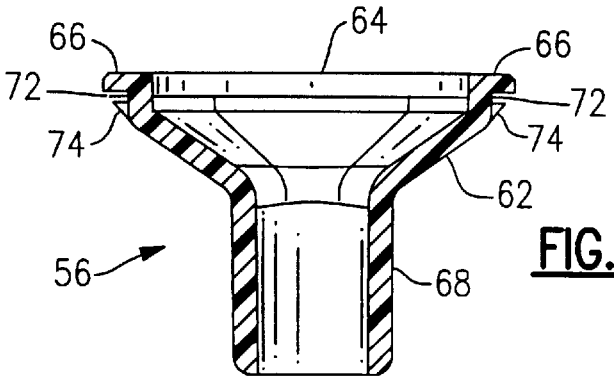
FIG. 7 is a section taken along the line 7—7 of FIG. 5.

As best seen in FIG. 4, the condensate collector 56 is installed into the opening 58 in the wall 60 by inserting it from the inside of the housing. A vertically extending top wall 72 of the body 62 is substantially the same dimension as the opening 58 so it is readily received therein with the flange 66 resting on the top of the wall 60. As best seen in FIG. 7, a pair of triangular-shaped protrusions 74 are provided on the elongated sections of the walls 72. These protrusions are configured to facilitate a snap fit of the collector into the opening 58 with the mating sections of the wall being received between the protrusions 74 and the flange 66.

As thus installed, the collector may function to receive condensate from whichever of the condensate drains 42/44 has been enabled. As seen in FIGS. 9–11, an appropriate condensate disposal conduit 76 may be installed onto the tubular sections 68 and routed to an appropriate condensate disposal location. As seen in FIG. 3 and 9–11, the boss 54, which includes the second condensate drain arrangement, defines an annular recess 78 on the underside thereof with the drain opening 48 actually being contained within a downwardly extending tubular extension 80 lying in the center of the annular space. In an optional installation, a condensate disposal conduit may be attached directly to the tubular extension 80 and the condensate collector would not be necessary in such an installation.

What is claimed is:

1. A condensate drain arrangement for an air conditioner comprising:

a molded plastic basepan having a substantially horizontally extending bottom wall, said bottom wall having an outdoor section which includes a region for collecting condensate therein;

a first condensate drain formed in said basepan in fluid communication with said region for collecting condensate, said first condensate drain being configured to conduct substantially all of the condensate collected within said region for collecting from said basepan, said first condensate drain being optionally enabled by the user of the air conditioner; and a second condensate drain formed in said basepan in fluid communication with said region for collecting condensate, said second condensate drain being configured to allow collection of condensate in said region to a predetermined depth and to conduct condensate which would exceed said predetermined depth from said basepan, said second condensate drain being optionally enabled by the user of the air conditioner.

2. The condensate drain arrangement of claim 1 wherein said region for collecting condensate is at a given elevation, and wherein said first condensate drain includes a first opening in said region of said basepan, said first opening having an entrance formed at said given elevation, further including removable material formed within said first opening to close off said first opening from fluid flow, said removable material being optionally removable by mechanical tooling.

3. The condensate drain arrangement of claim 2 wherein said second condensate drain comprises an upstanding boss formed in said region of said basepan, said boss defining a substantially horizontal upper surface lying at an elevation above said given elevation equal to said predetermined depth;

said boss having a second opening formed therein, said second opening having an entrance formed in said horizontal surface thereof, and further including removable material formed within said second opening to close off said second opening from fluid flow, said removable material being optionally removable by mechanical tooling.

4. The condensate drain arrangement of claim 3 wherein said first and second openings have outlets in the lower surface of said basepan, said air conditioner further including a metal outer housing, said housing having a lower wall configured to contact said lower surface of said basepan to support said basepan thereupon, said lower wall of said housing having an opening therein which is configured to be coextensive with said outlets of said first and second opening therein; and a condensate collector insert having an inlet substantially coextensive with said opening in said lower wall and configured to be attached to said lower wall with said inlet in registry with said opening, said condensate collector insert having a collector body underlying said inlet and a single outlet at the lower end of said collector body.

5. The condensate drain arrangement of claim 4 wherein said single outlet of said collector body comprises a downwardly extending tubular section.

* * * * *